US009611588B2

(12) United States Patent
Heiskanen et al.

(10) Patent No.: US 9,611,588 B2
(45) Date of Patent: Apr. 4, 2017

(54) METHOD FOR PROVIDING A SUBSTRATE WITH A BARRIER AND A SUBSTRATE COMPRISING A BARRIER

(75) Inventors: Isto Heiskanen, Imatra (FI); Kaj Backfolk, Lappeenranta (FI)

(73) Assignee: Stora Enso OYJ, Helsinki (FI)

( * ) Notice: Subject to any disclaimer, the term of this patent is extended or adjusted under 35 U.S.C. 154(b) by 616 days.

(21) Appl. No.: 13/581,533

(22) PCT Filed: Mar. 18, 2011

(86) PCT No.: PCT/IB2011/051138

§ 371 (c)(1),
(2), (4) Date: Aug. 28, 2012

(87) PCT Pub. No.: WO2011/114311

PCT Pub. Date: Sep. 22, 2011

(65) Prior Publication Data

US 2013/0004748 A1 Jan. 3, 2013

(30) Foreign Application Priority Data

Mar. 18, 2010 (SE) ..... 1050251

(51) Int. Cl.

| | |
|---|---|
| ***B32B 5/02*** | (2006.01) |
| ***D21H 19/10*** | (2006.01) |
| ***D01D 5/00*** | (2006.01) |
| ***D01F 6/14*** | (2006.01) |
| *D21H 15/02* | (2006.01) |

(Continued)

(52) U.S. Cl.

CPC ..... *D21H 19/10* (2013.01); *D01D 5/003* (2013.01); *D01D 5/0084* (2013.01); *D01F 6/14* (2013.01); *D21H 15/02* (2013.01); *D21H 19/84* (2013.01); *D21H 21/16* (2013.01); *Y10T 428/2481* (2015.01); *Y10T 442/2025* (2015.04); *Y10T 442/681* (2015.04)

(58) Field of Classification Search

CPC ..... D01D 5/0084; D21H 19/10
USPC ..... 427/206, 401, 462
See application file for complete search history.

(56) References Cited

U.S. PATENT DOCUMENTS

| | | | | |
|---|---|---|---|---|
| 2004/0223040 | A1* | 11/2004 | Graham et al. | 347/105 |
| 2005/0070866 | A1 | 3/2005 | Isele et al. | |
| 2007/0264520 | A1 | 11/2007 | Wood et al. | |

(Continued)

FOREIGN PATENT DOCUMENTS

| | | | | |
|---|---|---|---|---|
| JP | WO 2008093850 | A1 * | 8/2008 | B24B 37/24 |
| WO | 2008150970 | | 12/2008 | |

(Continued)

OTHER PUBLICATIONS

International Search Report and Written Opinion of International Application No. PCT/IB2011/051138, mailed Jun. 1, 2011.

(Continued)

*Primary Examiner* — Alexander Weddle
(74) *Attorney, Agent, or Firm* — Greer, Burns & Crain, Ltd

(57) ABSTRACT

The invention relates to a method for providing a surface of a fiber based substrate with a barrier layer wherein the barrier layer is formed by depositing nanofibers on the surface by the use of electrospinning or meltspinning and wherein the film is formed by post treatment of the substrate. The invention further relates to a substrate comprising such a carrier layer.

15 Claims, 4 Drawing Sheets

(51) Int. Cl.
*D21H 19/84* (2006.01)
*D21H 21/16* (2006.01)

(56) References Cited

U.S. PATENT DOCUMENTS

| | | | | |
|---|---|---|---|---|
| 2009/0020921 | A1* | 1/2009 | Cakmak et al. | 264/484 |
| 2009/0081377 | A1* | 3/2009 | Kubo | 427/496 |
| 2010/0015460 | A1* | 1/2010 | Heiskanen et al. | 428/537.5 |
| 2010/0087128 | A1* | 4/2010 | Nakayama | B24B 37/24 451/548 |

FOREIGN PATENT DOCUMENTS

| | | |
|---|---|---|
| WO | 2009-091406 | 7/2009 |
| WO | 2011114311 | 9/2011 |

OTHER PUBLICATIONS

Savolainen, A., "Polymer dispersions as barrier coatings," Paper and paperboard converting, Jyvaskyla, Fapet Oy, 1998, pp. 83-122, ISBN: 952-5216-12-8.

* cited by examiner

METHOD FOR PROVIDING A SUBSTRATE WITH A BARRIER AND A SUBSTRATE COMPRISING A BARRIER

FIELD OF THE INVENTION

The invention relates to a method for providing a surface of a substrate with a barrier layer by the use of electrospinning or meltspinning. It further relates to a substrate comprising a barrier layer.

BACKGROUND OF THE INVENTION

The market growth for plastic packages is steadily increasing. Future predictions indicate that this trend will remain and the growth in plastic packages partly is based on capturing market shares from fiber based packages. Fiber based packages can compete with plastic packages only if material and production costs can be reduced. One of the critical properties of fiber based packages is the barrier layer or layers, their functionality and the cost efficiency during production of barrier layers. Depending on the application, the barrier will be developed so it can provide the package with one or several barrier functionalities. Fiber based packages often requires a barrier layer in order to provide resistance towards penetration or diffusion of water or humidity, oil/fat/grease, aroma and/or gases.

Traditional barrier coating methods for paper and board products have been coating, impregnation, lamination or extrusion.

One of the barrier coating methods which has been under intensive research and development during recent years is dispersion barrier coating. By applying a dispersion or emulsion of polymer with blade or curtain coating technology, it is possible to offer a technology which would replace extrusion coating. The advantages with the dispersion barrier coating technology are that it offers a possibility for online coating of paper or board at the same time as it is possible to disintegrate the barrier coated paper or board which makes it easier to recycle the used fiber based substrate.

However, creating a single barrier layer by using dispersion coating might make it difficult to achieve all required properties for the package or product thereof. Typically, hot sealability and good barrier properties are difficult to obtain simultaneously for these kinds of manufactured barriers.

Another disadvantage with production of barrier by using dispersion coating is that the stability of the dispersion must be good in order to ensure good runnability. In order to achieve good stability of a dispersion it is necessary to add stabilizing components. However, by incorporating multiple components, the barrier dispersion preparation will be more difficult.

Another characteristic of the dispersion barrier is that at the formation of the barrier a substantial amount of water is applied to the substrate. This water needs to be evaporated off and high drying energy is therefore required in order to ensure a dry barrier and complete film forming of the barrier layer. Normally, the temperature of the dry coating must be significantly higher than the glass transition temperature of the polymer in order to ensure that film formation progresses. However, the use of high drying temperatures might also cause problems with blistering or adhesion between the barrier layer and the base substrate. Another problem with high drying temperature is that the tackiness of the polymer film increases due to that the temperature often will be above the glass transition temperature.

Yet another problem with traditional dispersion barrier coating is that the viscosity is relatively low (and also the solid content) which cause high level of penetration into the base substrate. This means that not only higher amount of coating is required to ensure pinhole free coating and good barrier properties, but also the fact that high drying energy is required. For uncoated board, typically 15-25 g/m2 of dry coating is required in order to get a pinhole free surface of the barrier layer.

There is thus a need for an improved method for producing paper or board with a single or multiple barrier layers in a cost efficient way.

SUMMARY OF THE INVENTION

One object of the present invention is to provide a surface of a fiber based substrate with a barrier layer in an improved way.

Another object of the present invention is to provide a method for addition of a thin barrier layer on a surface of a fiber based substrate.

Yet another object of the present invention is a fiber based substrate with improved barrier properties.

The above-mentioned objects, as well as other advantages, are attained by the method and the substrate according to the invention.

The invention relates to a method for providing a surface of a fiber based substrate with a barrier layer wherein the barrier layer is formed by depositing nanofibers on the surface by the use of electrospinning or meltspinning.

The barrier layer may be formed as a film on the surface of the fiber based substrate.

The film is preferably formed by post treating the substrate after depositing the nanofibers on the surface. It is preferred that said post treatment is done by increasing the temperature of the deposited nanofibers so that a film is formed. It is preferred that the temperature is increased to or above the glass transition temperature or the melting temperature of the deposited nanofibers so that a film is formed.

It is possible that at least two components are spun and deposited simultaneously to the surface of the substrate. The simultaneously spinning of different components may be done through different nozzles or other feeding arrangements, so that one component is spun through one nozzle and another component through another. In this way the barrier layer will comprise a mixture of different nanofibers making it possible to provide a single barrier layer with different properties, i.e. making a kind of composite material.

The barrier layer may comprise more than one layer, i.e. at least two layers. It is thus possible to provide the different layers with different properties.

It is preferred that the barrier layer has a dry weight of 0.1-20 g/m2, preferably 0.1-5 g/m2 or even more preferably 0.2-3 g/m2. It is possible to form a continuous pinhole free film on a porous surface with low amounts of deposited nanofibers.

The fiber based substrate may be provided with a coating layer to which the nanofibers are deposited. In this way a smoother surface is provided making it possible to reduce the amount of deposited fibers even further.

The barrier layer of the substrate may be provided with a coating layer. It is preferred that the coating layer comprises a polymer that is laminated or extrusion coated to the barrier layer.

The nanofibers are formed by electrospinning or meltspinning of a polymer, such as polyvinyl alcohol, varnish, polystyrene, polybutadiene, polyurethanes, polyethylene dispersions, polypropylene, PLA, chitosan, starch, sodium carboxymethyl cellulose, acrylate copolymers, polyvinyl acetate, poly ethylene oxide, polyethylene dispersions, polyethylene terephthalate dispersions, mixtures or its modified analogues of any of the mentioned components.

The electrospinning may be done with a liquid or dispersion comprising at least one polymer. It is also possible to use a solid polymer or a wax as a starting material which is melted, i.e. meltspinning.

The barrier layer may further be provided with functional properties by addition of a functional additive to the barrier. The functional additive may be spun together with the polymer. It is also possible that the functional additive is spun separately to form a separate layer of the barrier layers.

The invention further relates to a fiber based substrate which comprises a fiber base layer and a barrier layer wherein the barrier layer is formed by electrospun or meltspun nanofibers on the surface of the fiber base layer. The barrier layer is preferably a film formed by the deposited nanofibers.

The film may be formed by melted nanofibers, i.e. the deposited nanofibers may be melted to form said film. The film may also be formed by increasing the temperature of the nanofibers to or above the glass transition temperature whereby the fibers "flow" and a film will is formed. It is possible that the film is continuous, i.e. it completely covers the surface of the fiber base substrate and there are no pin-holes etc which makes it possible for components to reach the fiber base surface of the substrate.

The film may also be discontinuous. In some field of uses it is not necessary to completely cover the entire surface of the fiber base surface in order to achieve sufficient protection.

The barrier may be a barrier against liquid, vapour, oil, aroma, fat, grease, oil, solvents, heat, uv-light and/or gas.

If the film is discontinuous, the barrier may be a barrier against oil, grease and/or fat. It has been shown that sufficient barrier properties against oil, grease and/or fat may be achieved even though the film which forms the barrier is discontinuous, i.e. it comprises nanoholes or similar irregularities. This is due to that the contact angle between the film and the oil, grease and/or fat is big enough so that the oil will not penetrate through the barrier layer. This can be used for short time barrier properties, e.g. temporarily fat/grease barrier.

The barrier layer may comprise nanofibers of at least two components. By simultaneously spinning of different components, preferably through different nozzles or other feeding arrangements, it is possible to produce a barrier layer that comprises at least two components. In this way the barrier layer may have different properties since one component can give barrier properties against one compound, such as water and another component can give barrier properties against another compound, such as grease. In this way it is also possible to spin one component which will melt in order to form a film and one component which will support the melted component and prevent it to penetrate too deep into the base material, i.e. keep them on the surface of the fiber based substrate. It is thus possible that a single barrier layer comprises protection against several different compounds.

The barrier layer may comprise at least two layers. It is possible that the barrier layer comprises two or more layers. Each layer may have different properties, for example one layer may provide the substrate with barrier properties against vapour and a second layer may provide the barrier with heat-sealing properties.

The fiber base layer may be coated with any conventional coating before the deposition of nanofibers on the surface. Thus, the barrier layer is formed on the coated surface of the fiber based layer. In this way the barrier layer is formed on a smooth surface which makes it possible to reduce the amount of deposited nanofibers even further.

The barrier layer of the fiber based substrate may also be coated.

The invention further relates to a fiber based substrate produced according to the method described above.

DETAILED DESCRIPTION OF THE INVENTION

The present invention relates to a method for providing a surface of a fiber based substrate with a barrier layer wherein the barrier layer is formed by depositing nanofibers on the surface by the use of electrospinning or meltspinning.

It has been found that by depositing nanofibers on a surface of a fiber based substrate by the use of electrospinning or meltspinning it is possible to form a thin layer of nanofibers which will form a barrier layer on the surface. It has surprisingly been found that a thin layer of deposited nanofibers are sufficient in order to completely cover a rough surface, such as a surface of a fiber based substrate. Furthermore, due to the characteristic fiber dimension and fiber properties of the nanofibers produced and deposited by electrospinning or meltspinning, the penetration of the nanofibers into the substrate is insignificant. The nanofibers will thus be deposited on the surface and stay on the surface of the substrate. They will still bond in a satisfactory way to the surface of the substrate due to chemical and/or physicochemical interactions between the fibers of the substrate and the deposited nanofibers. There might also be some interdiffusion which can create mechanical or physical interlocking of the fibers. The deposited nanofibers will either coalesced or melt on the surface of the substrate to form a film which will work as the barrier. By depositing fibers on the surface before having a complete film a substantially lower amount of coating is needed, this is due to the fact that the penetration into the substrate is much lower or even insignificant compared to other barriers formed on fiber based substrates created with other coating techniques. Consequently, the film formation according to the invention is formed from a fiber network which should be compared to prior art solutions where films are formed from a solution or a dispersion.

The amount of fibers added to the surface of the fiber based substrate depends on different parameters, for example on the roughness of the surface. It is preferred that the barrier layer has a dry weight of 0.1-20 g/m2, preferably 0.1-5 g/m2 or even more preferably 0.2-3 g/m2. If the surface to which the barrier layer is added is rough a higher amount of fibers need to be added and it is the preferred that the dry weight of the barrier layer is between 2-20 g/m2.

By optimizing the spinning conditions it is possible to increase the moisture during the spinning so that the deposited fibers are coalesced into a film. The first deposited fibers will be dry or they will have a high solid content which makes the rheology of the fibers high. This is partly due to that the surface to which they are deposited on is dry. The spinning conditions will thereafter change so that the following deposited fibers are wetter, i.e. semidry. This results in that the fibers are coalesced to a film which will work as an excellent barrier. The dryness and/or solids of the liquid or air used during the electrospinning or meltspinning can be controlled so that the fibers will coalesced to a film. It is also possible to control the moisture, temperature, production rate and spinning distance so that the fibers will form a film. In this way it is possible to produce a fiber based substrate in a very easy way.

It is also possible to post treat the substrate or the surface of the substrate together with the deposited nanofibers in order for the nanofibers to form a film. It is preferred to use a heat treatment which will increase the temperature of the deposited nanofibers so that the properties of the deposited nanofibers changes whereby a film is formed. It is preferred to increase the temperature to or above the glass transition temperature or the melting temperature of the nanofibers. In this way the properties of the deposited nanofibers will change, e.g. they will start to "flow" or melt, and they will thus form a film which will work as a barrier layer of the fiber based substrate. Depending on the material used for the production of nanofibers and on the time of the treatment, it may not be necessary to increase the temperature to or above the glass transition temperature. For some materials it may be sufficient to increase the temperature some, still being below the glass transition temperature, in order for the properties of the deposited nanofibers to change and form a film. The heating can be done by the use of flame, infra-red dryer, fuser roll, air-dryer, plasma, steam, laser UV, EB or any other known technique. It is also possible to use hot fusing or hot nip in which the deposited fibers are heated and simultaneously formed to a thin film on the substrate. It is also possible post treat the deposited nanofibers by increasing the pressure, preferably in combination with increased temperature. Another possible post treatment is subjecting the nanofibers to an electric field. Other possible post treatments may be radiation curing, e.g. IR, NIR etc. If the deposited fibers are hot it is also possible to cool them and thus form a film by decreasing the temperature.

The substance or substances to be formed into nanofibers by the use of electrospinning or meltspinning may be polymers or a blend of polymers. Suitable polymers may be chosen from e.g. polyolefins, polyvinyls, polyamides, polyimides, polyacrylates, polyesters, and mixtures thereof. It is especially preferred to use polyvinyl alcohol, varnish, polystyrene, polybutadiene, polyurethanes, polyethylene dispersions, polypropylene, PLA, chitosan, starch, sodium carboxymethyl cellulose, acrylate copolymers, polyvinyl acetate, poly ethylene oxide, polyethylene dispersions, polyethylene terephthalate dispersions, mixtures or its modified analogues of any of the mentioned components. The polymer used depends on the end use of the fiber based substrate. The different polymers will form a barrier layer against different properties, for example will PVA form a barrier layer against grease.

The present invention makes it possible to provide a barrier layer comprising at least two components. This can be done by simultaneously spin two or more components which thus will be deposited on the surface of the substrate. The simultaneously spinning of two or more components may be done through different nozzles or other feeding arrangements, so that one component is spun through one nozzle and another component through another. In this way the barrier layer will comprise a mixture of different nanofibers making it possible to provide a single barrier layer with different properties, i.e. making a kind of composite material. For example may one component give barrier properties against one compound, such as water and another component can give barrier properties against another compound, such as grease. In this way it is also possible to spin one component which will melt in order to form a film and one component which will support the melted component and prevent it to penetrate too deep into the base material, i.e. keep them on the surface of the fiber based substrate. It is thus possible that a single barrier layer comprises protection against several different compounds.

A big advantage with the present invention is that it is possible to provide the barrier layer with more than one layer in an easy way. It is thus possible to produce a barrier layer which fulfils different properties which previously has demanded several process steps. In this way it is possible to provide the barrier layer with several layers with different properties, for example one prime layer, a barrier layer, a protective layer, a hot sealable layer and/or a blocking resistant layer. The use of different polymer dispersions gives different properties. For example, a polyurethane dispersion will give a barrier against aroma, fat and grease as well as sealability properties. A fiber based substrate with a polyurethane barrier will thus be easy to seal in order to form a package at the same time as it has great barrier properties. If the polyurethane barrier layer is combined with an ethylene layer the fiber bases substrate will also have a barrier against water.

The surface of the fiber based substrate may be provided with a coating layer. Consequently, the nanofibers will be deposited on the coating layer of the fiber based substrate. In this way the deposition of the coating layer is done on a smooth surface and the amount of nanofibers may be even further reduced. The coating can be of any conventional coating colour, such as calcium carbonate or kaolin.

The barrier layer of the substrate may be provided with a coating layer. It is preferred that the coating layer comprises a polymer that is laminated or extrusion coated to the barrier layer. In this way the barrier layer may comprise a primer which will increase the adhesion between the fiber based substrate and an extrusion coated layer making it possible to increase the speed of the extrusion coating process. The coating layer may also comprise any conventional coating components, both polymer layer as well as pigment coating layer.

It is also possible to provide the barrier layer with functional properties by the addition of a functional additive to the medium which is spun. Possible additives may be fillers which may increase whiteness or provide the substrate with UV protection or absorbents which may trap taste and odor chemicals and thus reduce problems. The functional additive may be mixed with the medium, preferable a polymer dispersion, and thus be spun together with the polymer. The nanofibers formed will thus comprise a mixture of polymer nanofibers and nanofibers from the additive. It is also possible to incorporate an additive to the formed nanofibers. Yet another possibility is to spin the functional additive simultaneously with a polymer, as described above.

It is also possible to use a solid medium, such as a solid polymer or a wax, as a starting medium of the nanofiber forming process. This is normally called meltspinning. A big advantage with this method is that no water or liquid is added to the surface of the substrate and there is thus no need to evaporate the added water off by increased drying. It is thus possible to decrease the amount of drying, saving both energy and time.

The fiber based substrate is preferably a paper or board produced from lignocelluloses. Other fiber based substrate such as non-woven, or textiles may also be used.

The formation of particles is carried out by electrospinning or meltspinning, whereby ultrafine fibers are formed.

The diameter of single fibers may, e.g., be less than 5 μm or even less than 40 nm. The term electrospinning or meltspinning relates to generation of fibers in the nanosize region due to viscoelastic and electrostatic forces. The medium from which the fibers are formed may be a foam, a melt or a solid material, preferable a polymer.

It is preferred that the formed nanofibers are deposited on a paper or board substrate. The particles can, e.g., be applied to a moving web of paper or paperboard during the paper making process. The method of the invention can thus be used for e.g. coating or sizing of paper or board. The method may be used to incorporate various types of polymer fibers, directly onto or incorporated into the surface of paper or board.

The electrostatic particle formation of the present invention may be carried out by means of a conventional apparatus suitable for electrospinning. The apparatus may comprise a collector, a feed section and a voltage source adapted to provide an electrical potential difference between the collector and the feed section. The collector may be a metal plate for supporting the substrate, although a plate, a roll, a belt, a drum, a cylinder or the like also may be possible to use. The electrostatic voltage is preferably between 10 and 100 kV, more preferably between 40 and 60 kV, and the distance between the medium and the substrate is preferably between 10 and 300 mm, more preferably about 50 mm.

The electrospinning of the particles can be conducted using both direct and/or alternating voltages. In one embodiment of the invention, the electrostatic processing is performed in the presence of an alternating current (AC) electric field. This can be achieved by applying an alternating electrical potential to either of the electrodes forming the electric field, e.g. an alternating electrical potential can be applied either to the feed section or to the collector. The use of AC potentials gives rise to an improved coverage of the deposited surface by the formed particles.

The electrospinning may also be performed using both alternating current and direct current simultaneously. In this way, the form of the particles produced in the process may be varied. According to one embodiment, an alternating electrical potential is applied to the collector and a direct electrical potential is applied to the feed section, whereby particles in the form of quite large fibers may be produced. In another embodiment, an alternating electrical potential is applied to the feed section and a direct electrical potential is applied to the collector, whereby more fine particles may be produced.

The feed section of the apparatus suitable may, e.g. be an opening, one or a number of nozzles or it is also possible to spin from an open surface, i.e. a free flowing liquid surface of roll.

EXPERIMENTAL

The invention is further described with reference to some examples below. It is to be understood that the invention is not limited to the particular process steps and materials disclosed herein. The results are shown in the attached figures.

Example 1

Nanofibers produced by the use of electrospinning were deposited on an uncoated paperboard sample. The polymer used was polyvinyl alcohol and the concentration of the e-spun solution was slightly less than 10% by weight, whereas the deposited fibers have high solid content due to evaporation occurring during transfer between nozzle and substrate.

Figure 1A:
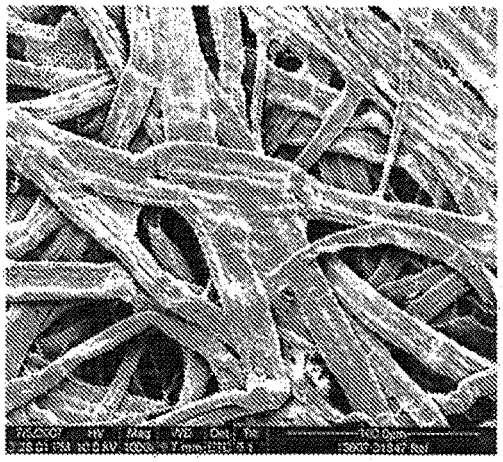
FIG. 1*a*) shows an uncoated paperboard used as a reference.

The pictures attached have been taken with a Scanning Electron Microscope (SEM) and FIG. 1*a* shows a picture of an uncoated paperboard used as a reference. The fibers and the pores between fibers are evident from this picture.

Figure 1B:
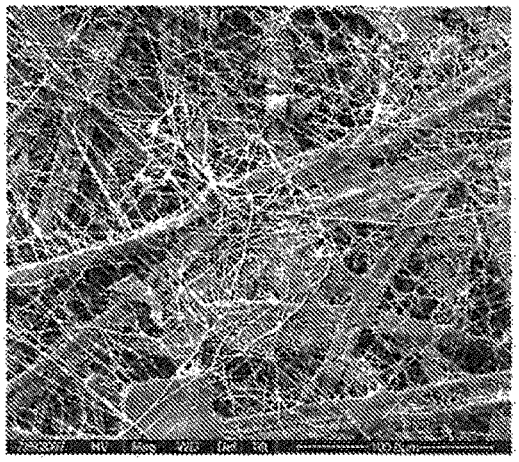
FIG. 1*b*) shows an e-spun paperboard coated with 0.3 g/m$^2$.
Figure 1C:
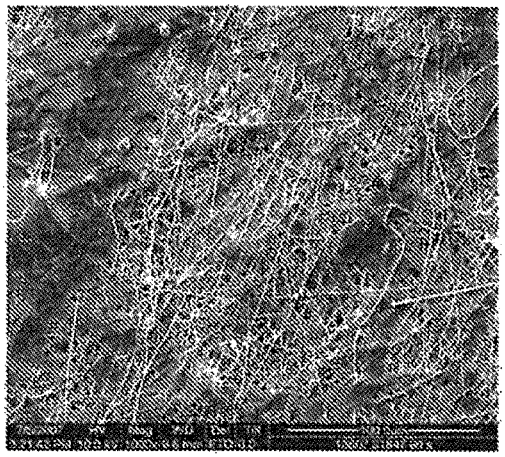
FIG. 1*c*) shows an e-spun paperboard coated with 1.2 g/m$^2$.

In FIGS. 1*b* and 1*c*, the weights of the deposited nanofibers are gradually increased which can be seen as higher amount of nanofibers but also that the local fiber-fiber coalescence of the nanofibers starts.

The even spots shown in FIG. 1*c* indicate that a film has been formed. These spots were obtained by changing the electrospinning conditions so that the deposited nanofibers were partly wet, i.e. semidry, and hence coalesced into a film. Thus, no external heating was applied in this case to get the film formation.

Example 2

Two paperboard samples which have been coated with e-spun nanofibers to a dry weight of 1.2 g/m2 as described in example 1 were post treated by heating. By heat-treating the deposited e-spun fibers it is possible to melt the deposited fibers in order to create a film. The coat weights in this case were quite low but it still gave an almost complete coverage of the paperboard which demonstrates the advantages of the present invention.

Figure 2A:
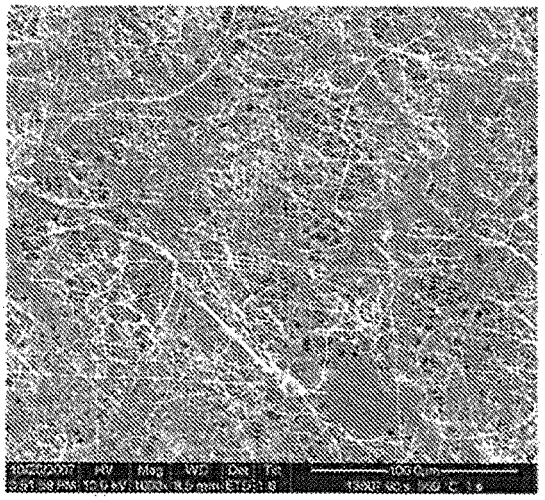
FIG. 2*a*) shows an e-spun paperboard with a coat weight (dry) of 1.2 g/m$^2$ and heated in the oven at 550° C. for 1 s.
Figure 2B:
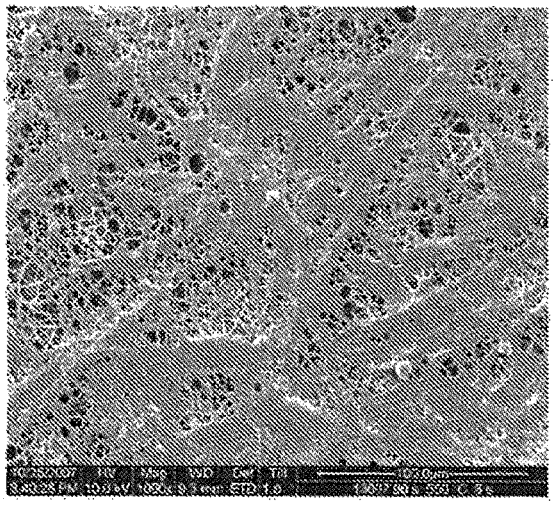
FIG. 2*b*) shows an e-spun paperboard with a coat weight (dry) of 1.2 g/m2 and treated in the oven at 550° C. for 3 s.

The paperboard samples were treated in an oven at 550° C. for 1 s and 3 s, respectively. FIGS. 2*a* and 2*b* demonstrates the effect of post heating of the spun coated samples.

Example 3

Commercial barrier chemicals (Cartaseal, Clariant) were tested and applied onto paperboard using the said deposition or coating method as described above. In this case, the flow properties were adjusted with polyethylene oxide.

Recipe was:

2000 g Cartaseal VGL respectively FTU of 10% solids 200 g polyethylene oxide 600 000 of 6%

Hence, e-spun fibers were created onto the substrate. In this particularly case, a rough substrate was used and the targeted dry coat weight was 10 g/m$^2$. The paperboard was thereafter dried at 115° C. for 10 minutes and SEM images were captured on the spun coated paperboard.

Figure 3A:
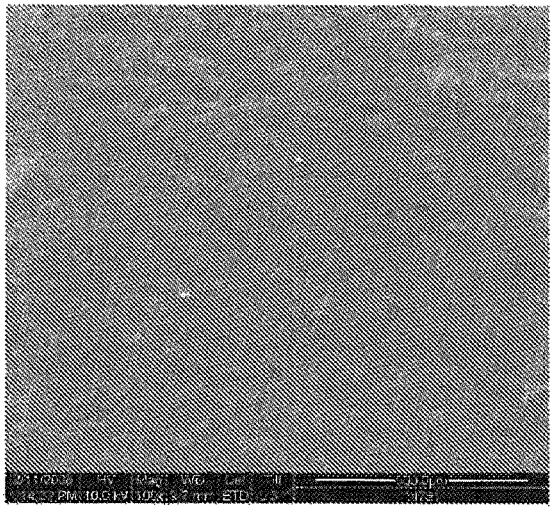
FIG. 3*a*) shows a paperboard with a coating with electrospinning using Cartaseal VGL after post heating.
Figure 3B:
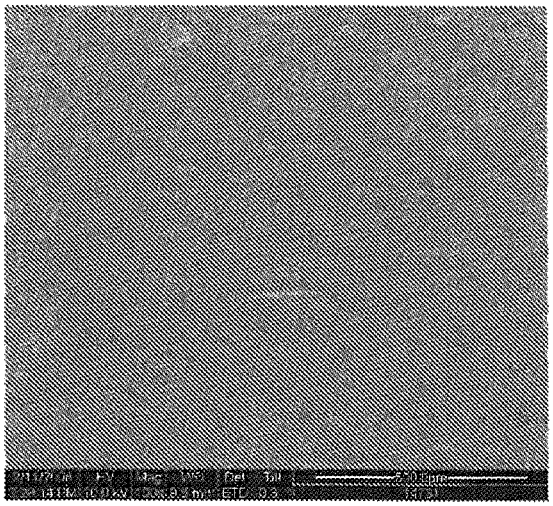
FIG. 3*b*) coating with electrospinning using Cartaseal FTU after post heating.

Results shown in FIG. 3*a* and FIG. 3*b* demonstrate that full coverage was obtained and that no pinholes exists.

Table I demonstrates the results from the fat/grease resistance tests according to a modified ASTM F 119-82 standard test procedure which includes testes for specified chemicals at given temperature (40° C.).

TABLE I

| Chemical | Grease resistance through board, Show trough time | Grease resistance through board to the TLC plate, Break-through time |
|---|---|---|
| Cartaseal VGL | >52 h | >52 h |
| Cartaseal FTU | >52 h | >52 h |

The invention claimed is:

1. A method for producing a fiber based packaging material with a barrier layer, the method comprising providing a fiber based substrate having a surface, depositing ultrafine polymer fibers having a diameter less than 5 μm on the surface of the substrate by the use of electrospinning or meltspinning, and post treating the substrate together with the polymer fibers on the surface to cause the polymer fibers to melt and coalesce together into a barrier layer film on the surface of the substrate, wherein the post treating step comprises at least one of increasing the temperature of the ultrafine polymer fibers, applying pressure to the ultrafine polymer fibers, subjecting the ultrafine polymer fibers to an electric field, radiation curing of the ultrafine polymer fibers, and decreasing the temperature of the ultrafine polymer fibers.

2. The method according to claim 1 wherein the post treating step comprises increasing the temperature to or above the glass transition temperature or melting temperature of the deposited ultrafine polymer fibers so that a film is formed.

3. The method according to claim 1 wherein the ultrafine polymer fibers that are deposited comprise at least two components that are spun simultaneously in order to deposit the components to the surface of the substrate in a single step.

4. The method according to claim 1 wherein the barrier layer comprises at least two layers.

5. The method according to claim 1, wherein the barrier layer has a dry weight of 0.1-20 g/m2.

6. The method according to claim 1, wherein the surface of the fiber based substrate is provided with a coating layer before the ultrafine polymer fibers are deposited on the surface.

7. The method according to claim 1, wherein the barrier layer is provided with an additional coating layer that is laminated or extrusion coated to the barrier layer.

8. The method according to claim 1 wherein the ultrafine polymer fibers are formed by electrospinning or meltspinning a polymer selected from the group consisting of polyvinyl alcohol, varnish, polystyrene, polybutadiene, polyurethanes, polyethylene dispersions, polypropylene, PLA, chitosan, starch, sodium carboxymethyl cellulose, acrylate copolymers, polyvinyl acetate, poly ethylene oxide, polyethylene dispersions, polyethylene terephthalate dispersions, mixtures or its modified analogues of any of the mentioned components.

9. The method according to claim 8 wherein the electrospinning is done with a liquid or dispersion comprising the polymer.

10. The method according to claim 1 wherein the barrier layer further is provided with a functional property by addition of a functional additive.

11. The method according to claim 10 wherein the functional additive is spun together with the polymer.

12. The method according to claim 10 wherein the functional additive is spun as a separate layer of the barrier layers.

13. A method for providing a surface of a fiber based substrate with a barrier layer which barrier layer is formed as a film by depositing nanofibers on the surface by the use of electrospinning or meltspinning wherein the film is formed by post treating the substrate together with the nanofibers on the surface, wherein the post treating causes the polymer fibers to melt to form the barrier layer film on the surface of the substrate, and wherein the nanofibers that are deposited comprise at least two components that are spun separately and simultaneously in order to deposit nanofibers of the components to the surface of the substrate in a single step.

14. A method for providing a surface of a fiber based substrate with a barrier layer which barrier layer is formed as a film by depositing nanofibers on the surface of the fiber based substrate by the use of electrospinning or meltspinning wherein the film is formed by post treating the substrate together with the deposited nanofibers on the surface, wherein the post treating causes the polymer fibers to melt to form the barrier layer film on the surface of the substrate, and wherein the surface of the fiber based substrate is provided with a separate coating layer before the nanofibers are deposited on the surface.

15. A method for providing a surface of a fiber based substrate with a barrier layer which barrier layer is formed as a film by depositing nanofibers on the surface of the fiber based substrate by the use of electrospinning or meltspinning wherein the film is formed by post treating the substrate with deposited nanofibers on the surface, wherein the post treating causes the polymer fibers to melt to form the barrier layer film on the surface of the substrate, and wherein the barrier layer further is provided with a functional property by addition of a functional additive.

* * * * *